US005138923A

United States Patent [19]

Kent et al.

[11] Patent Number: 5,138,923

[45] Date of Patent: Aug. 18, 1992

[54] ROTARY DIE CUTTER

[75] Inventors: Gregory A. Kent, Rolling Prairie; Philip D. Frye, Middlebury; Russell S. Brayton, Elkhart, all of Ind.

[73] Assignee: Atlas Die, Inc., Elkhart, Ind.

[21] Appl. No.: 243,881

[22] Filed: Nov. 18, 1988

[51] Int. Cl.[5] ..... B26D 1/24; B31B 1/14

[52] U.S. Cl. ..... 83/665; 29/117; 29/130; 83/343; 83/495; 83/673; 83/698; 403/358; 493/60

[58] Field of Search ..... 83/343, 659, 346, 331, 83/345, 505, 698, 699, 677, 673, 495, 665; 493/160, 60, 355, 403; 29/110, 117, 121.1, 121.6, 130; 403/358, 356

[56] References Cited

U.S. PATENT DOCUMENTS

| | | | |
|---|---|---|---|
| 2,992,844 | 7/1961 | Williams | 403/358 |
| 3,285,642 | 11/1966 | Sauer | 83/659 X |
| 3,404,907 | 10/1968 | Kane et al. | 403/358 X |
| 3,578,761 | 5/1971 | Sarka | 83/343 |
| 3,841,774 | 10/1974 | Maxey | 403/358 |
| 3,965,786 | 6/1976 | D'Luhy | 83/659 X |
| 3,981,213 | 9/1976 | Lopman | 493/60 X |
| 4,031,600 | 6/1977 | Whigham | 83/659 X |
| 4,073,208 | 2/1978 | Kirkpatrick | 83/659 |
| 4,498,527 | 2/1985 | Gerarts et al. | 29/117 X |
| 4,525,095 | 6/1985 | Lamb et al. | 403/358 X |
| 4,770,078 | 9/1988 | Gautier | 83/659 X |
| 4,800,644 | 1/1989 | Muellenberg | 29/117 X |
| 4,934,231 | 6/1990 | Chesnut et al. | 83/343 |

*Primary Examiner*—Frank T. Yost
*Assistant Examiner*—Kenneth E. Peterson
*Attorney, Agent, or Firm*—James D. Hall

[57] ABSTRACT

A rotatable cylinder to which is secured a unitary sleeve having cutting lands for cutting and creasing sheet material such as paper and cardboard. The sleeve is secured to the cylinder to prevent relative movement during the cutting process.

4 Claims, 6 Drawing Sheets

ROTARY DIE CUTTER

SUMMARY OF THE INVENTION

This invention relates to die cutters and will have special application to rotatable cutters for material such as paper cardboard, and other materials.

Rotary plate die cutting of paper products has been gaining widespread acceptance in the folding carton industry. This process of cutting involves the use of male and female dies which are placed on adjacent rotating cylinders. The dies are aligned slightly offset at a predtermined gap to produce a "burst" cut. Creasing or scoring may be accomplished by pushing the sheet material with a male land into an opposed channel formed by two female lands. The process is described in detail in U.S. Pat. No. 3,355,969, incorporated herein by reference. Previously, the male and female lands were machined directly on the rotating cylinders. When the lands wore out the cylinders has to be replaced at great cost.

The die cutter of this invention includes a unitary sleeve which is secured to the rotating cylinder. The sleeve includes the male and/or female lands. When the lands wear out, the only part which requires replacement is the sleeve. Great cost savings are realized by requiring replacement of the sleeve only which may have the lands formed thereon by chemical etching or other economical process.

Accordingly, it is an object of this invention to provide for a novel rotary die cutter.

Another object is to provide for a rotary die cutter which is efficient, economical, and provides for ease in installation.

Another object is to provide for a two piece rotary die cutter in which a unitary sleeve containing the cutting and creasing lands is secured about a rotating cylinder.

Other objects will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

Figure 1:
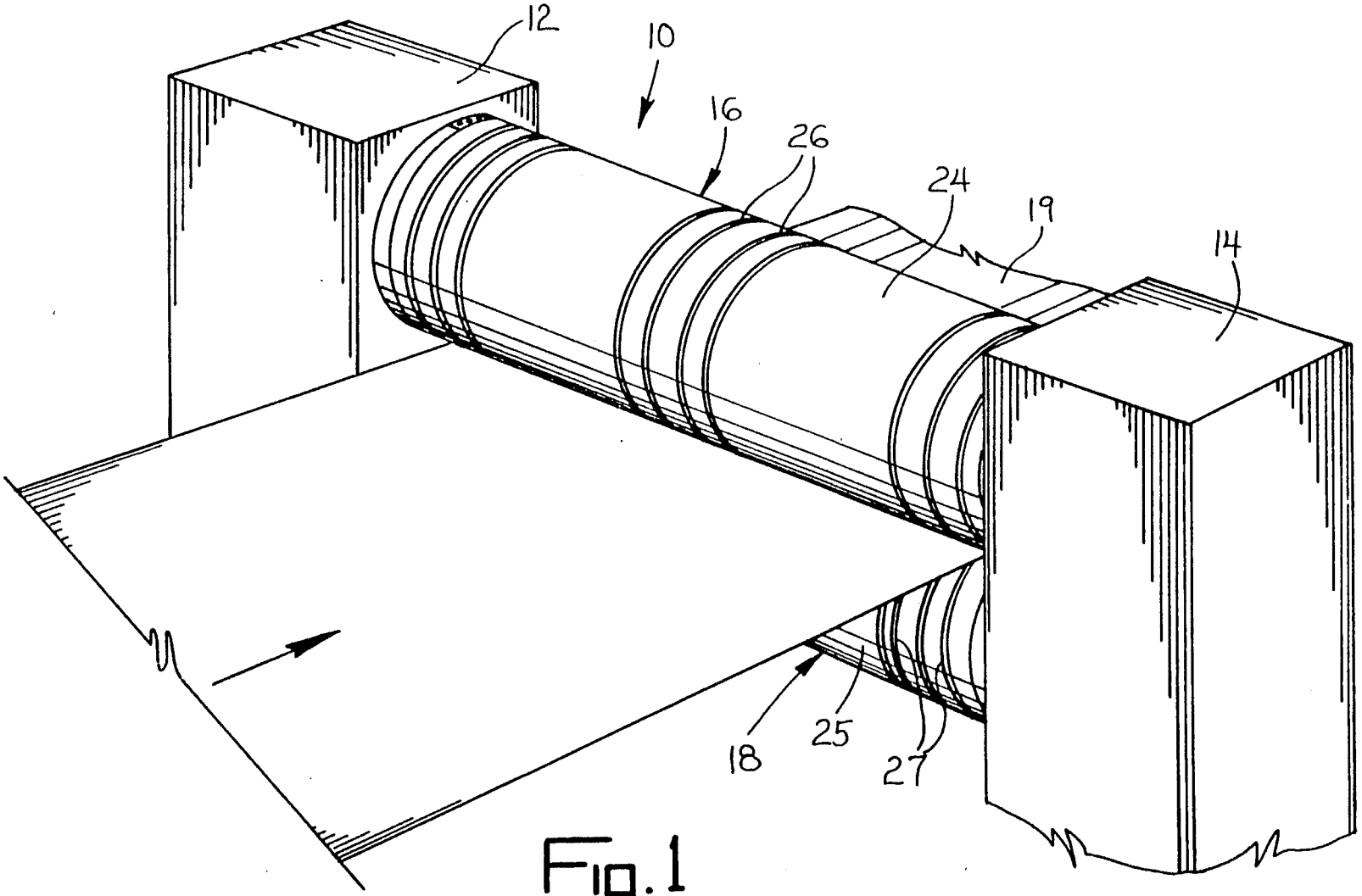
FIG. 1 is a fragmentary perspective view of a rotary die cutter constructed according to the principles of the invention.
Figure 2:
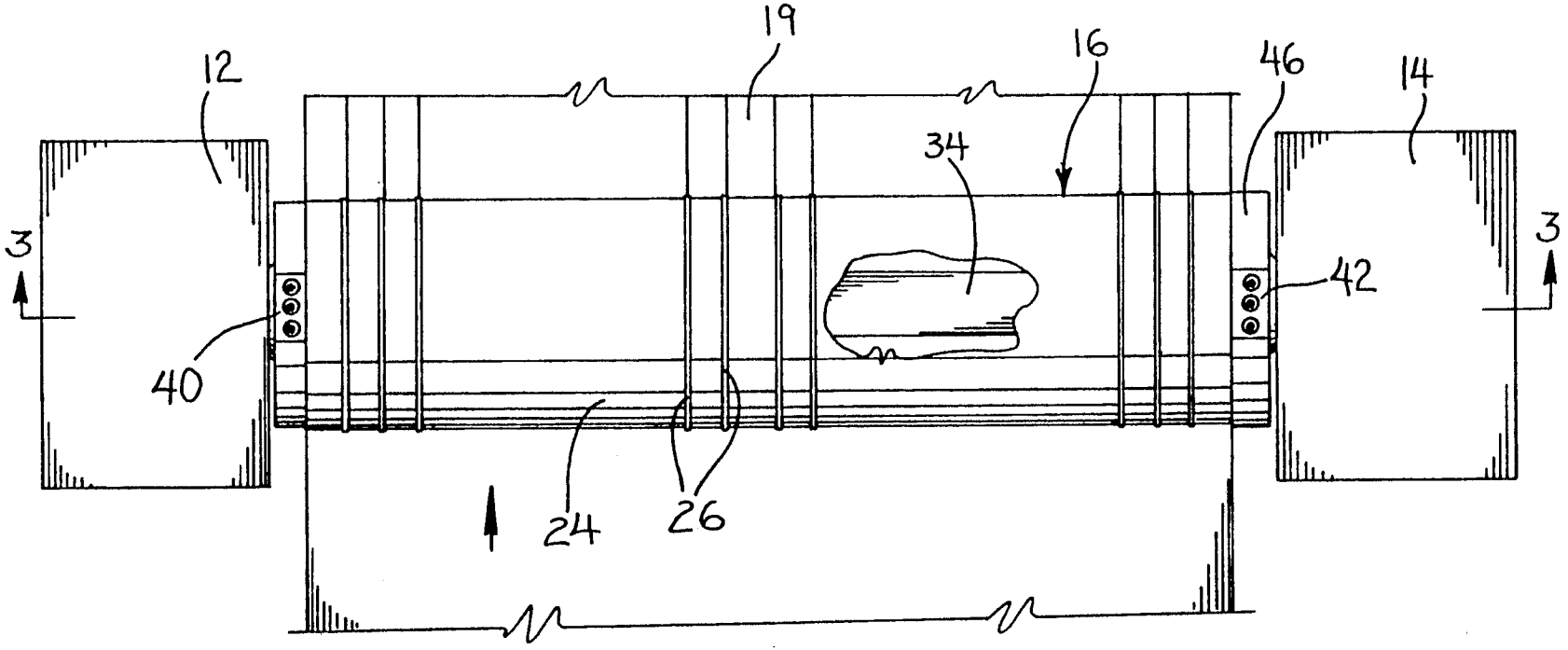
FIG. 2 is a top plan view of the rotary die cutter with a portion cut away to illustrate the gibs.
Figure 3:
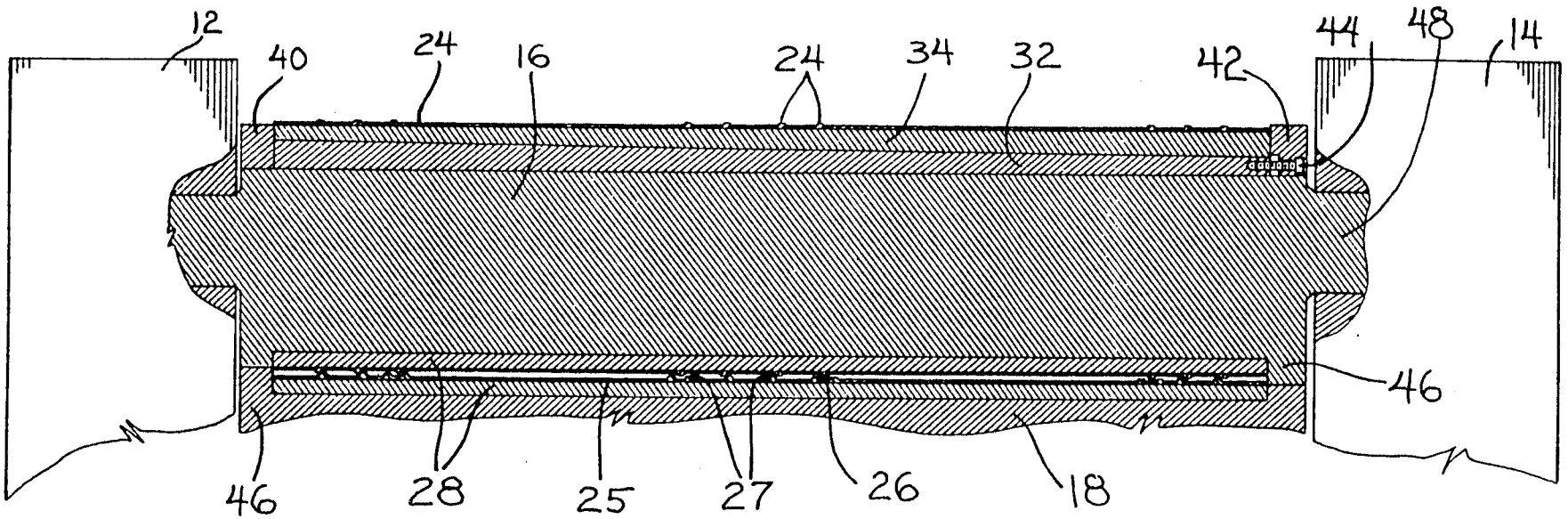
FIG. 3 is a fragmentary sectional view taken along line 3—3 of FIG. 2.

The preferred embodiment herein described is not intended to be exhaustive or to limit the invention to the precise form disclosed. It is chosen and described to explain the principles of the invention and its application and practical use to enable others skilled in the art to utilize the invention.

Referring now to the drawings, reference numeral 10 refers generally to the rotary die cutter shown. Cutter 10 includes bearing blocks 12, 14 which journal a pair of cylinders 16, 18 therebetween. Previously, these cylinders 16, 18 included a plurality of cutting and creasing lands machined into the cylinder to cut and/or crease material 19 which may be paper, paper board, cardboard, thin sheet metal, or similar material desired to be cut or creased. The principle of rotary die cutting is shown in U.S. Pat. No. 3,355,969, incorporated herein by reference. The exact configuration of the cutting and creasing lands will depend on the desired size and shape of the parts to be formed and does not constitute part of the subject matter of this invention.

Figure 4:
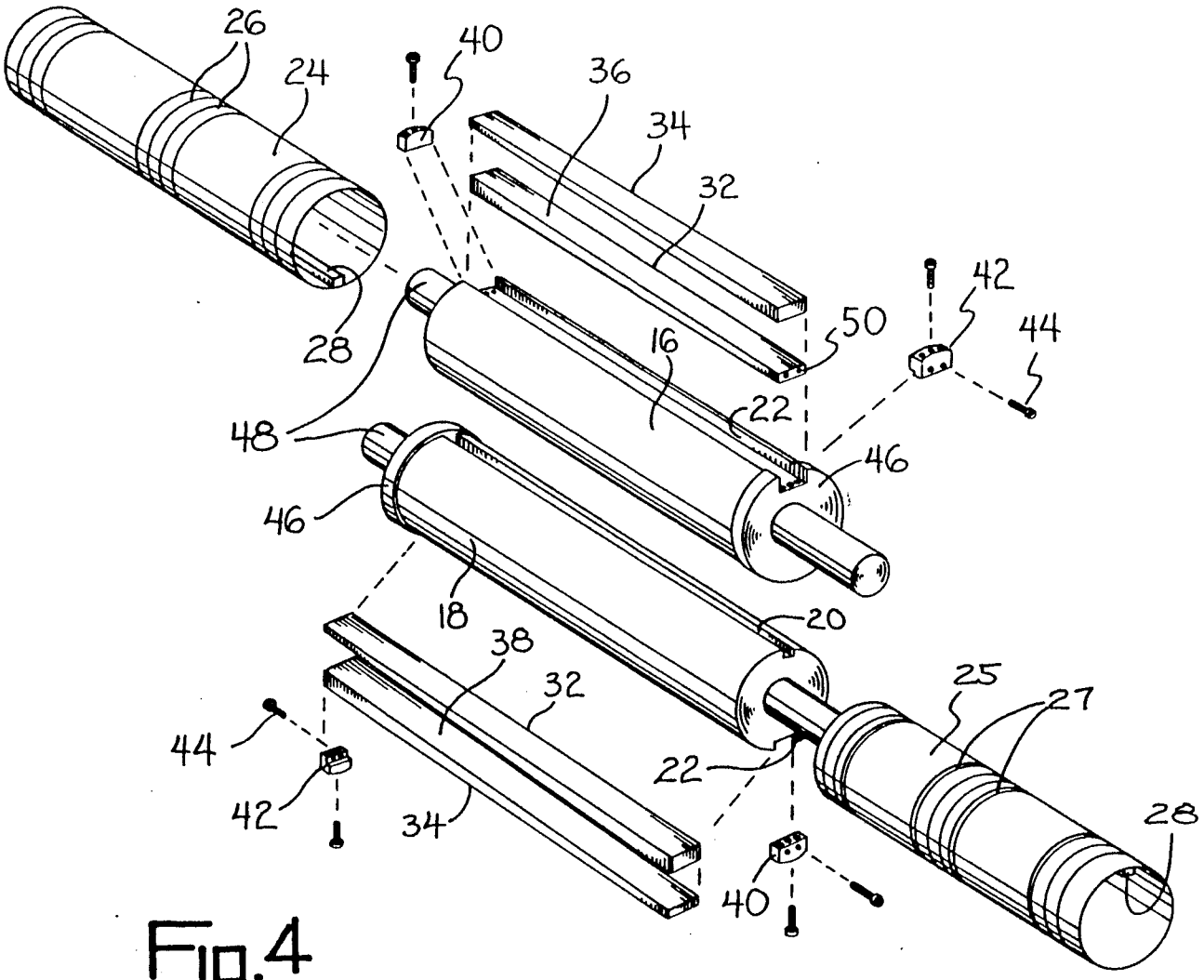
FIG. 4 is an exploded view of the die cutting sleeves and cylinders.
Figure 5:
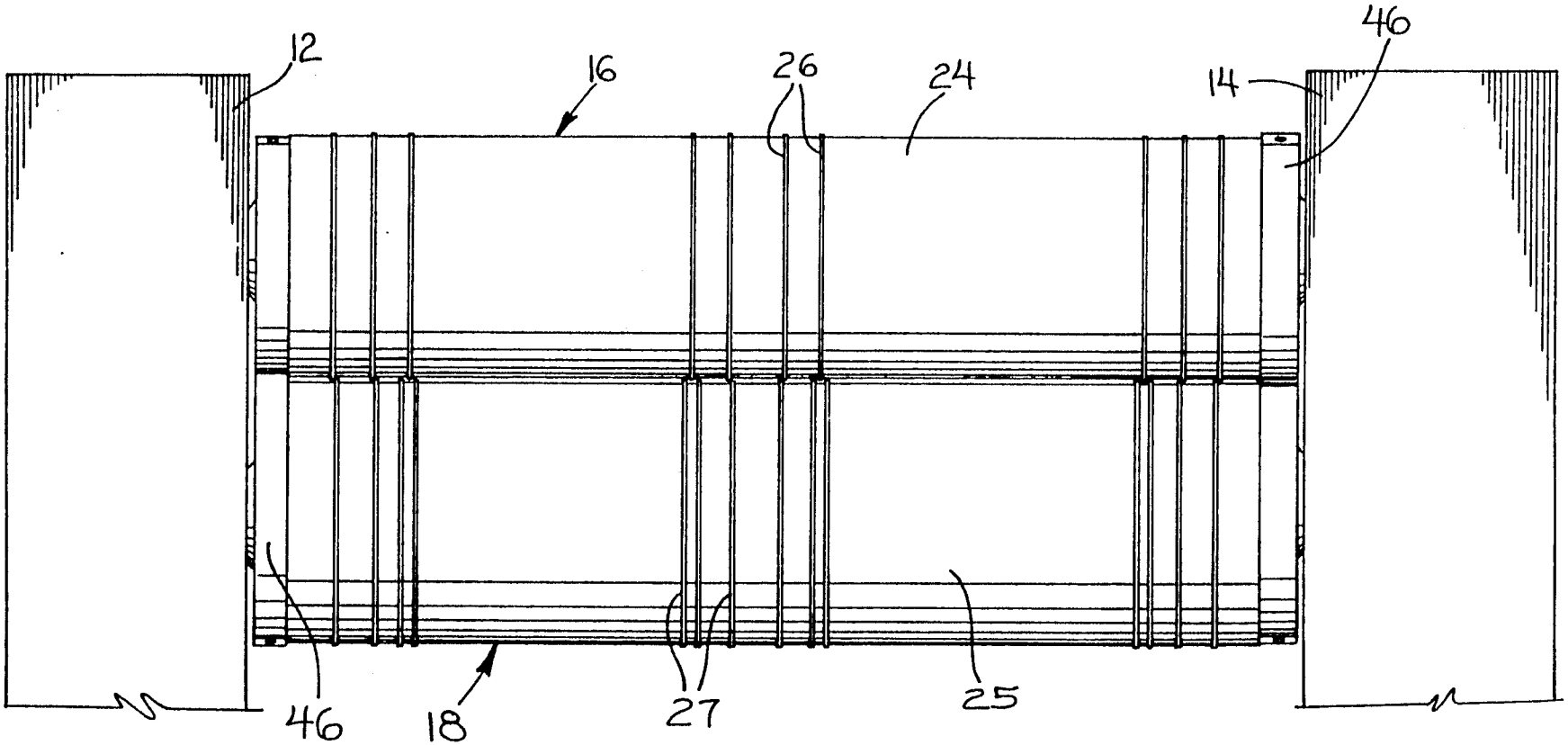
FIG. 5 is a fragmentary elevation view of the rotary die cutter.
Figure 7:
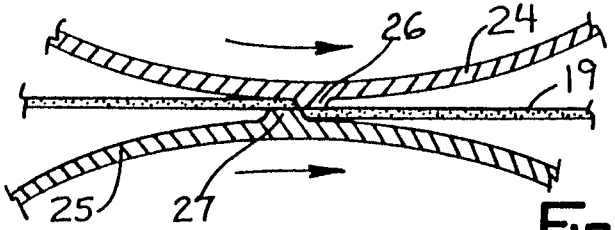
FIG. 7 is a fragmentary sectional view showing cutting of the material.
Figure 6:
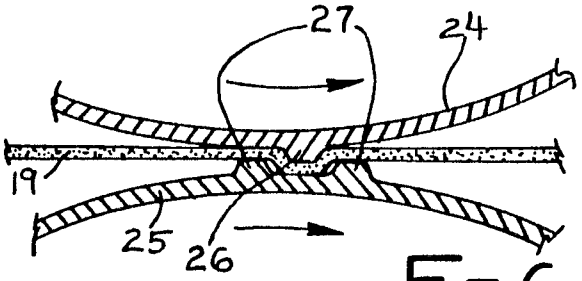
FIG. 6 is a fragmentary sectional view showing creasing of the material.

FIG. 4 illustrates the preferred construction of cylinders 16, 18. Since the construction of the cylinders is essentially identical only the construction of cylinders 16 will be described with the understanding that cylinder 18 includes the same components. Cylinder 16 is preferably elongated and has a longitudinal keyway 20 which runs substantially the length of the cylinder. Cylinder 16 also defines a slot 22 which runs the entire length of the cylinder and is spaced from keyway 20.

Sleeve 24 is formed from thin, resilient sheet metal, such as steel or other similar metals, and rolled into the cylindrical form shown. A plurality of lands 26 are formed on the outer surface of sleeve 24 as by chemical etching or other known process. Key 28, which corresponds to the dimensions of keyway 20, is positioned adjacent the inner surface of sleeve 24 across longitudinal seam 30. Sleeve 24 is welded by conventional means along seam 30 so to secure the key 28 to the sleeve and to allow the sleeve to hold its cylindrical shape.

Cylinder 16 also includes a pair of sliding gibs 32 and 34. Each gib 32, 34 includes an inclined face 36, 38 aligned as shown and fitted slidably within cylinder slot 22. Gib 34 has an arcuate upper face 39. (FIGS. 8-9) Block 40 prevents movement of gibs 32, 34 outwardly of slot 22 in one direction. Slotted block 42 is positioned at the opposite end of cylinder slot 22 and allows relative sliding movement of gibs 32, 34, such as by turning screws 44. Cylinders 16, 18 also include bearers 46, 47 located at the end of the cylinders and journal pins 48. Bearers 46, 47 serve to prevent crashing of the die.

Figure 9:
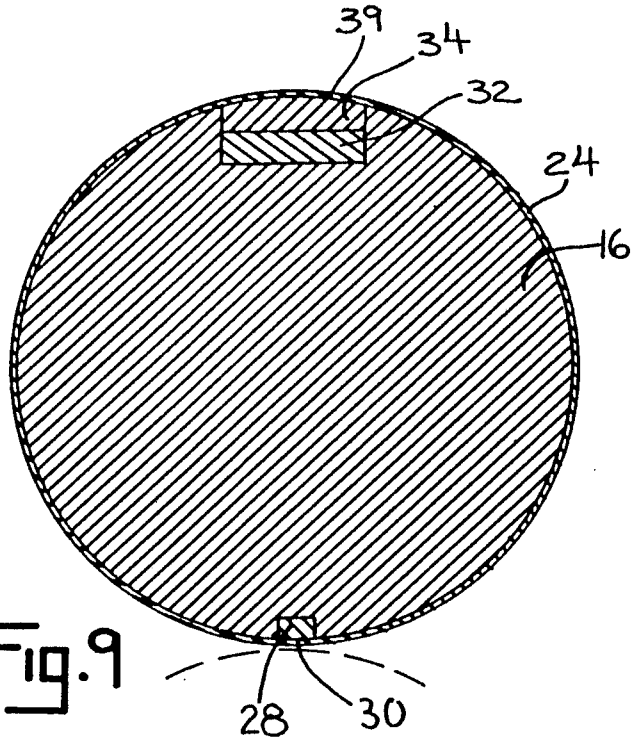
FIG. 9 is a cross-sectional view similar to FIG. 8 showing the gibs in an expanded, operational position securing the sleeve to the cylinder.
Figure 8:
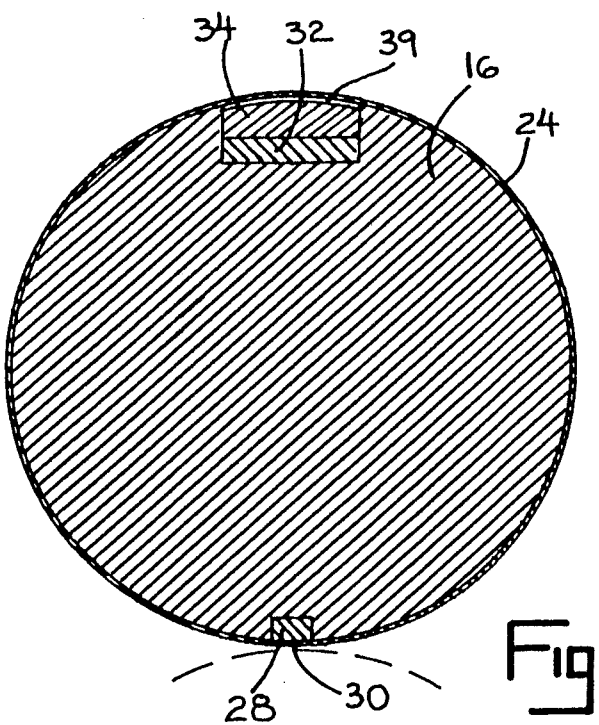
FIG. 8 is a cross-sectional view of one of the cylinders with the gibs in a standby position.

To assemble cylinders 16, 18, formed sleeve 24 is slid over the cylinder with key 28 fitted in keyway 20. Sleeve 24 preferably closely overlies cylinder 16 as shown in FIGS. 8 and 9. Screws 44 are then turned to slide and gib 32 towards block 42. A gib 32 is moved, the inclined surfaces 36, 38 of gibs 32, 34 slide and gib 34 is urged into contact with the inner surface of sleeve 24. It should be understood that although a pulling movement of gib 32 is illustrated, the same result is achieved by switching the position of blocks 40, 42 and drilling the threaded bores 50 in the other end of the gib 32 to effect a pushing movement on gib 32. Cylinder 18 is then assembled in the same fashion and the two cylinders 16, 18 fitted in bearing blocks 12, 14 in a conventional fashion.

In typical operation, material 19 is continuously fed into cutter 10 between cylinders 16, 18. Male lands 26 of sleeve 24 are aligned and slightly spaced both vertically and horizontally from female lands 27 of sleeve 25 so that when material 19 passes therethrough the material is cut. Alternatively, if a portion of paper board 52 is to be creased for folding male land 26 will pass between two spaced female land 27 to crease the paper board as it passes through the die cutter 10. As previously mentioned, the orientation of the male and female lands 26 and 27 on sleeves 24 and 25 will depend entirely upon the predetermined size and configuration of the objects to be formed from material 19.

It should also be understood that the method outlined for sliding gibs 32, 34 into the operational position of FIG. 9 is only for illustrative purposes and other well-known methods of sliding the gibs into their clamped position could be employed without deviating from the objective of the invention.

What is claimed is:

1. A die cutter comprising a rotatable cylinder, means for rotating said cylinder about its longitudinal axis, and a unitary sleeve fitted about said cylinder, said sleeve including means for cutting sheet material which contacts said sleeve, said cylinder includes means for securing said sleeve to said cylinder, said means for securing including first and second gibs, a notch defined in said cylinder accommodating said gibs, said gibs each defining an inclined mating surface, and means for sliding the first gib with respect to the second gib to urge said second gib against said sleeve, said means for sliding including an adjustment block positioned in said notch adjacent one end of said gibs, adjustable means extending from said block into said first gib to effect sliding movement thereof relative to the second gib into an expanded position, said adjustment block defining a slotted notch for accommodating said first gib in an expanded position of the sleeve.

2. The die cutter of claim 1 and means for securing said ajustment block and said stop block to said cylinder.

3. A die cutter comprising a rotatable cylinder, means for rotating said cylinder about its longitudinal axis, and a unitary sleeve fitted about said cylinder, said sleeve including means for cutting sheet material which contacts said sleeve, said cylinder including means for securing said sleeve to said cylinder, said securing means for securing including first and second gibs, a notch in said cylinder accommodating said gibs with said second gib overlying said first gib, said gibs including inclined mating surfaces, means for sliding the first gib with respect to said second gib to cause the second gib to contact said sleeve, said sliding means further including a separate adjustment block secured in said notch and abutting one end of said second gib, ajustable means extending from said block into said first gib to effect said sliding thereof relative to the second gib.

4. The die cutter of claim 3 and further including a separate stop block positioned in said notch adjacent an end of said gibs opposite said one end.

* * * * *